United States Patent [19]

Mannor

[11] 4,163,508

[45] Aug. 7, 1979

[54] DISPOSABLE CUP DISPENSER

[75] Inventor: Arden Mannor, Tatum, Tex.

[73] Assignee: Carthage Cup Company, Carthage, Tex.

[21] Appl. No.: 805,740

[22] Filed: Jun. 13, 1977

[51] Int. Cl.[2] ..... B65D 5/16

[52] U.S. Cl. ..... 221/310; 229/17 B; 206/499; 206/628

[58] Field of Search ..... 206/499; 221/310, 308, 221/303, 307; 229/17 B, 51 D

[56] References Cited

U.S. PATENT DOCUMENTS

| | | | |
|---|---|---|---|
| 2,648,429 | 8/1953 | Smith | 221/310 X |
| 3,409,183 | 11/1968 | Gish | 221/308 |
| 3,933,303 | 1/1976 | Kirby, Jr. | 229/17 B |

FOREIGN PATENT DOCUMENTS

| | | | |
|---|---|---|---|
| 486430 | 9/1952 | Canada | 221/310 |

*Primary Examiner*—Stanley H. Tollberg

*Attorney, Agent, or Firm*—Hubbard, Thurman, Turner, Tucker & Glaser

[57] ABSTRACT

A disposable single-service cup dispenser carton is disclosed. The carton is fabricated from a blank of flexible sheet material which is pre-cut and scored to define panel enclosure portion to permit the blank to be folded and erected into a tubular carton which can be collapsed during shipping and which can be folded when erected to enclose a stack of nested cups. The carton includes a dispensing panel connected intermediate side panels having pre-cut portions and perforations which delineate a tear line forming the boundary of a dispensing opening. The portion of the end panel circumscribed by the tear line is removable to permit the withdrawal of a cup from a nested stack of cups enclosed by the carton. The dispensing opening is characterized by a substantially circular edge interrupted by a plurality of radially projecting tabs which are circumferentially spaced relative to each other around the periphery of the dispensing opening. In a preferred embodiment, the diameter of the circular edge of the dispensing opening is substantially equal to the outside diameter of the rolled edge of the cup, and the diameter of the dispensing end panel portion enclosed by the tear line as measured between radially opposite tabs is substantially equal to the diameter of the open end of the cup which is joined to the rolled edge.

5 Claims, 7 Drawing Figures

DISPOSABLE CUP DISPENSER

BACKGROUND OF THE INVENTION

1. Field of the Invention

The present invention relates in general to the container art, and in particular, the invention relates to a disposable single-service cup dispenser carton.

2. Description of the Prior Art

According to conventional practice, disposable plastic or wax coated paper containers such as drinking cups are arranged in a nested stack and are enclosed within a disposable shipping carton. In the construction of such shipping cartons, it is desirable to provide an enclosure which permits the nested cups to be transported without damaging during ordinary handling and which provides a sanitary covering for the cups during storage. For certain applications, it is also desirable to equip the shipping carton with a dispensing opening so that the cups may be withdrawn one by one as required while providing a sanitary storage enclosure for the remaining cups.

The provision of a shipping carton which can also function as a single-service dispenser offers a competitive advantage over the prior art single function shipping cartons. Examples of prior art carton structures having a single-service dispensing opening may be found in the following U.S. Pat. Nos. 1,633,983 to Dawson et al; 2,325,277 to Rothe et al; 2,991,910 to Coe; 3,121,511 to Whitehead; 3,155,276 to Williamson et al; and, 3,246,800 to Stone.

SUMMARY OF THE INVENTION

The disposable cup dispensing carton of the present invention comprises a blank of flexible sheet material which is pre-cut and scored to define panel enclosure portions which permit the blank to be folded and erected into a tubular carton for enclosing a nested stack of drinking cups. The one-piece blank is characterized by a pair of longitudinally extending side panels, an integrally formed dispensing end panel disposed intermediate the side panels, a top closure panel integrally formed with one of the side panels, a top closure flap integrally formed with the other side panel, and first and second side closure flaps integrally formed on laterally opposite sides of each panel. The intermediate boundary of each panel and side closure flap is delineated by a longitudinally extending score line, and the intermediate boundary formed between each side panel and the end panel is delineated by a laterally extending score line.

In a preferred embodiment, the dispensing end panel is provided with pre-cut portions and perforations which delineate a tear line forming the boundary of a dispensing opening. The portion of the end panel which is circumscribed by the tear line is removable to permit withdrawal of a nested article through the dispensing opening. The dispensing opening is characterized by a substantially circular edge which is interrupted by a plurality of radially projecting tabs circumferentially spaced relative to each other around the periphery of the dispensing opening. Single-service dispensing action for drinking cups is provided by the engagement of the radial tabs with the tapered sidewall section of a cup and with the radially extending rolled edge of the open end of the cup. The diameter of the circular edge of the dispensing opening is substantially equal to the outside diameter of the rolled edge of the cup, and the diameter as measured between radially opposite tabs is substantially equal to the outside diameter of the tapered sidewall body portion of the cup which is joined to the rolled edge.

The foregoing and other objects, advantages and features of the invention will hereinafter appear, and for purposes of illustration, but not of limitation, an exemplary embodiment of the subject invention is shown in the appended drawing.

DETAILED DESCRIPTION

Figure 1:
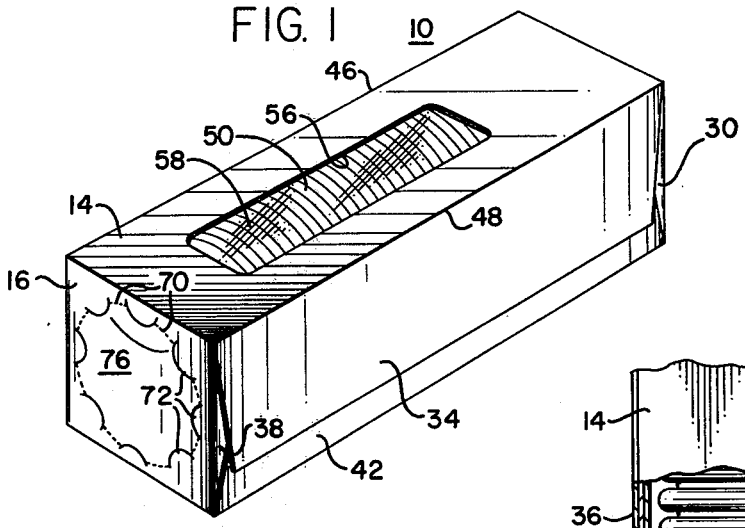
FIG. 1 is a perspective view of a disposable cup dispenser carton constructed according to the teachings of the present invention in which a nested stack of cups is enclosed.
Figure 5:
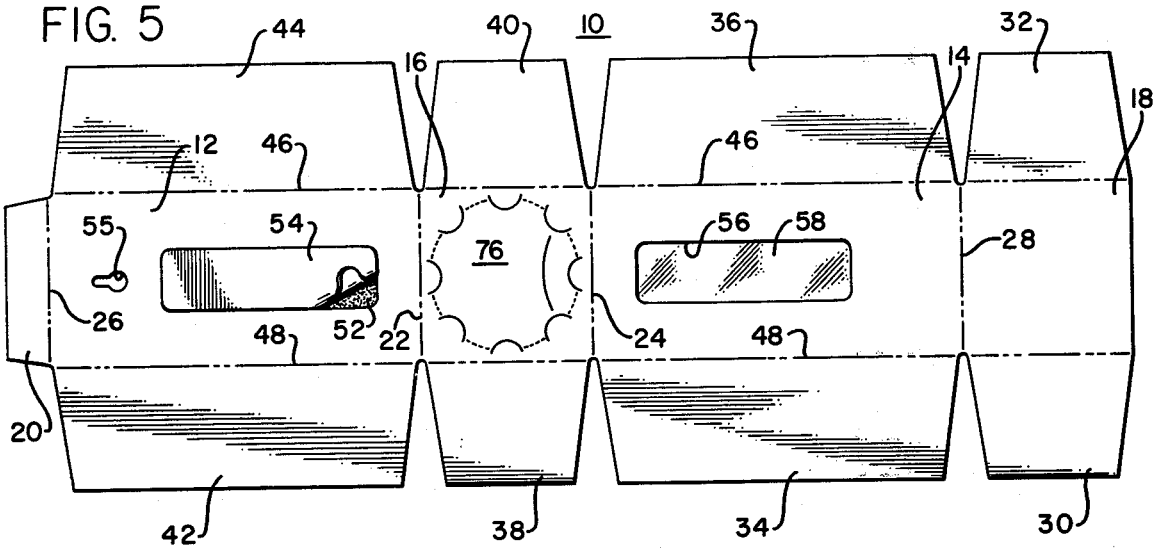
FIG. 5 is a plan view of a blank of flexible sheet material which is pre-cut and scored to define the panel enclosure portions of the carton shown in FIG. 1.

A disposable single-service cup dispensing carton 10 constructed according to the teachings of the invention is shown erected in FIG. 1 of the drawing and collapsed in FIG. 5 of the drawing. The carton 10 is preferably formed from a blank of flexible sheet material such as paperboard stock which is pre-cut and scored to define panel and closure portions as illustrated in FIG. 5 to permit the blank to be folded and erected into a tubular carton. The pre-cut and scored panel and closure portions include a pair of longitudinally extending rear and front panels 12, 14 and an integrally formed dispensing end panel 16 disposed intermediate the rear and front panels. A top closure panel 18 is integrally formed on one end of the front panel 14, and a top closure glue flap 20 is integrally formed on an end portion of the rear panel 12. The glue flap 20 may be secured by adhesive means to the underside of the top closure panel 18 so that the carton 10 may be shipped partially pre-assembled and collapsed by folding the carton along lateral score lines to minimize its collapsed dimensions.

The intermediate boundary of each side panel with the end panel 16 is delineated by laterally extending score lines 22, 24 respectively. Similarly, the intermediate boundary of the glue flap 20 with the rear panel 12 is delineated by a laterally extending score line 26, and the intermediate boundary of the top closure panel 18 with the front panel 14 is delineated by a laterally extending score line 28. Side closure flaps are integrally formed on laterally opposite sides of each panel as can best be seen in FIG. 5 of the drawing. These side closure flaps are identified as 30, 32 for the top closure panel 18; 34, 36 for the front panel 14; 38, 40 for the end panel 16; and, 42, 44 for the rear panel 12. The intermediate boundary of each panel and side closure flap combination is delineated by a pair of score lines 46, 48 which extend longitudinally over the entire pre-cut blank. The provision of the pre-cut panel and closure portions in combination with the score lines permits rapid erection of the carton 10.

The carton as thus formed may be shipped semi-erected to a manufacturer of cups who completes the carton erection and packaging of the cups. The carton 10 is erected by folding the panels and closure members along the preformed lateral and longitudinal score lines after the pre-cut blank has been passed through a gluing operation to apply glue to the under side of the closure flaps as viewed in FIG. 5. The panels and side closure portions are then folded along the score lines, a stack of nested cups is inserted into the semierected carton, and the remaining side closure flaps are folded in overlapping relation to each other and with the side closure flaps of the top closure panel 18.. This structure provides the carton 10 with a square cross section which is slightly larger than the diameter of the open end of the nested cups.

When the carton 10 is to be suspended for use, a non-tacky adhesive strip 52 may be applied to the rear panel 12 for sticking or hanging the carton 10 on a wall surface or the like, in such a manner that it may be readily removed and discarded when empty. The adhesive strip 52 is preferably covered by a removable covering 54 to preserve the adhesive qualities of the strip 52 prior to use. The rear panel 12 may also be provided with a pre-cut punch-out opening 55 for engagement with the head of a wood screw or nail as an alternate means for suspending the carton during use. A viewing window 56 which is covered by a strip 58 of cellophane or other clear transparent material may be fabricated in the front panel 14 to provide an indication of the number of cups remaining in the carton 10.

Figure 2:
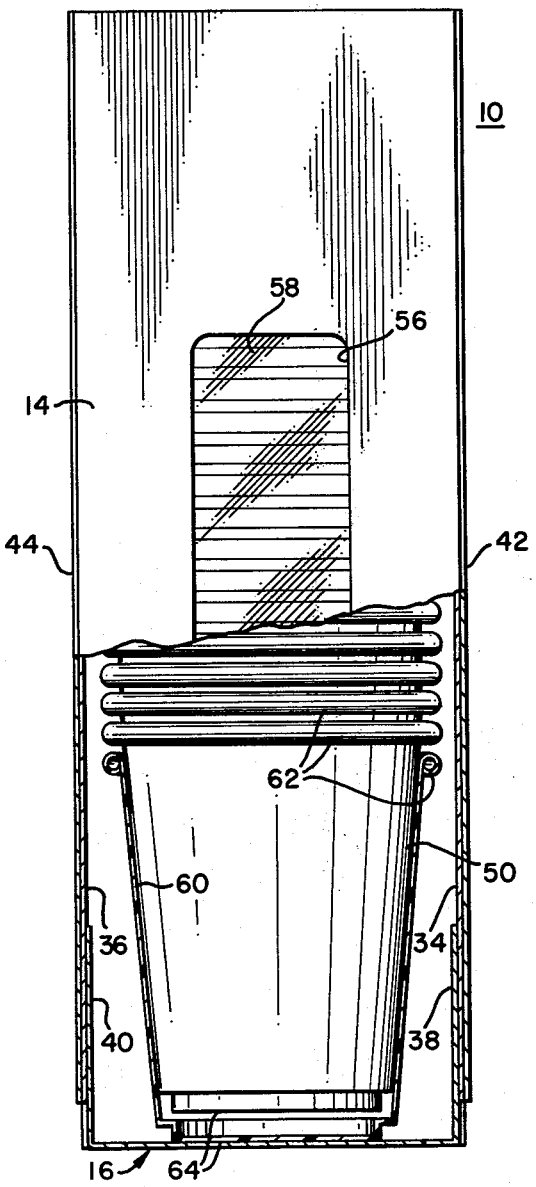
FIG. 2 is a front elevation view, partly in section, of the cup and carton combination shown in FIG. 1.
Figure 4:
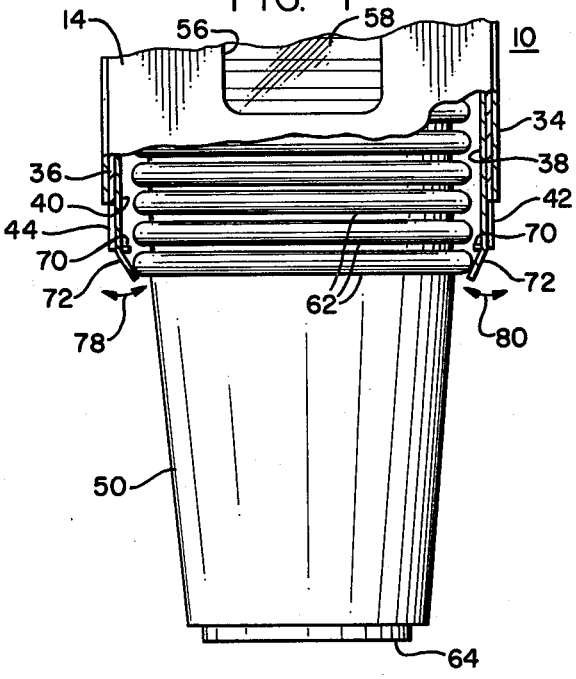
FIG. 4 is a view similar to FIG. 3 which illustrates the single-service structure of the invention.
Figure 7:
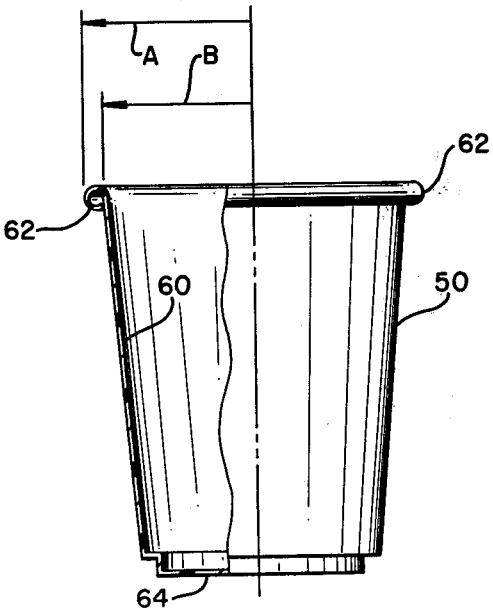

In carrying out the invention, the carton 10 is particularly adapted for containing and dispensing drinking cups 50 of the type illustrated in FIG. 7. Each cup 50 is characterized by tapered sidewall 60, a rolled edge 62, and a closed bottom portion 64 which may be formed, for example, by vacuum forming techniques. When placed in the carton 10, the cups 50 will be nested in a stack as shown in FIG. 2 of the drawing, and by this arrangement a relatively large number of cups can be placed in a carton of comparatively small size.

According to an important object of the invention, the carton 10 provides a sanitary enclosure for a nested stack of cups 50 during transportation and storage of the cups, and it also provides means for dispensing the cups one at a time. In this arrangement, because the carton also serves as a sanitary enclosure for the cups during storage, until such time that it is desired to utilize the carton 10 as a dispensing container it is essential that the dispensing means be inoperative and serve to protect the enclosed stack of cups. However, when it is desired to withdraw a cup, the dispensing means should be simple to make ready. Accordingly, the dispensing end panel 16 of the carton 10 is provided with a pre-cut and perforated tear line which is characterized by a substantially circular perforated edge 70 which is interrupted by a plurality of pre-cut radially projecting semicircular tabs 72 which are circumferentially spaced relative to each other around the periphery of the dispensing opening as can best be seen in FIG. 6 of the drawing. If desired, a pre-cut slit 74 can be formed in the portion 76 of the end panel 16 which is enclosed by the tear line to provide a convenient opening for insertion of a finger to facilitate removal of the central portion 76 as it is torn away along the perforated edge 70.

Figure 3:
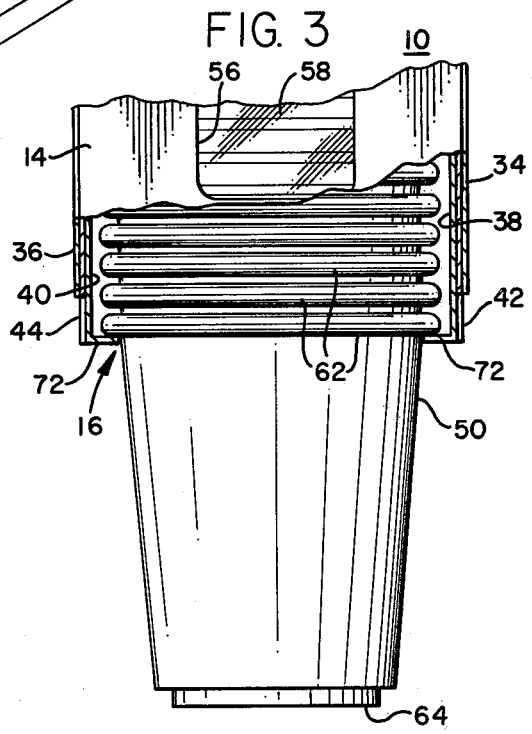
FIG. 3 is a front elevation view, partly in section, showing the carton of FIG. 1 open and ready for use.
Figure 6:
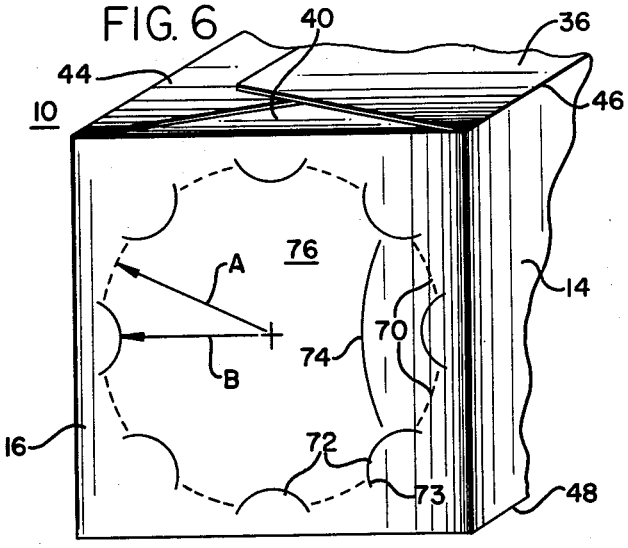
FIG. 6 is a partial isometric view of an end portion of the carton of FIG. 1 which illustrates the construction details of the tear out dispensing opening of the carton; and, FIG. 7 is an elevation view, partly in section, of a drinking cup which may be nested in a stack and dispensed one by one from the carton of FIG. 1.

In order to assure single-service withdrawal of a cup 50 from the stack of nested cups, the radius of the perforated edge 70 is preferably substantially equal to the outside radius of the rolled edge of the cup as is illustrated in FIGS. 6 and 7 by the dimension reference A. The radius of the dispensing end panel portion 76 enclosed by the tear line as measured between radially opposite tabs 72 is preferably substantially equal to the dimension reference B of the open end of the cup 50 which is joined to the rolled edge 62. According to this structural arrangement, the radially extending tabs 72 support the stack of cups along the under side of the rolled edge 62 of the lowermost cup of the stack as is illustrated in FIG. 3 of the drawing. The semicircular tabs 72 because of their relatively short radial extension provide relatively rigid support for the weight of the nested stack of cups without yielding axially in the absence of external loading. However, because the semicircular tabs 72 are constructed of a relatively flexible material such as paperboard or plastic, they will yield and deflect in response to external loading in the directions indicated by the arrows 78, 80 as a cup 50 is withdrawn from the carton.

The diameter of the perforated edge 70 is substantially equal to the outer diameter of the rolled edge 62 of the cup which permits the rolled edge 62 to pass in registration with the perforated edge 70 as the cup 50 is withdrawn. However, because in the usual operation of withdrawing a cup the lowermost cup will be tilted slightly as it is withdrawn, the remaining cups in the nested stack are also tilted slightly and the rolled edge 62 of the next adjacent cup in the stack will overlap and engage the surrounding end panel 16 and thereby prevent further axial movement of the remaining stack. The semicircular tabs 72, being relatively inflexible because of their short radial length, return relatively quickly to engage the underside of the rolled edge 62 of the next adjacent cup, thereby assuring single-service operation.

The resiliency or spring constant of the semicircular tabs 72 can be adjusted for best results by increasing and decreasing the radial extent of the tabs relative to the perforated edge 70, or by increasing and decreasing the depth of the semicircular cut relative to the perforated line into the dispensing end panel 16 as noted at 73. When the pre-cut portions of the semicircular tabs are extended into the dispensing end panel 16 beyond the perforated edge 70, a second group of relatively inflexible tabs are defined which alternate around the dispensing opening with the semicircular tabs 72. This structure enhances the resilient cooperation of the tabs with the rolled edge of the cup.

When it is desired to remove a cup from the nested stack enclosed by the carton 10, the tapered sidewall 60 of the lowermost cup is grasped and drawn downwardly with the semicircular tabs 72 yielding sufficiently to allow the rolled edge 62 to pass through the opening defined by the perforated edge 70. After the lowermost cup 50 has been withdrawn, the semicircular tabs 72 return to their original undeflected position, to provide support for the next adjacent cup in the nested stack.

From the foregoing discussion and detailed description, it will be apparent that a disposable, single-service cup dispenser carton has been disclosed which may be manufactured economically and which provides a sanitary enclosure for a nested stack of cups during transportation and storage. The carton also provides a normally closed dispensing opening which may be easily opened when it is desirable to convert the carton from a shipping function to a dispensing function. The dispensing opening permits single-service delivery of the cups from the carton by simple and natural motions on the part of the user.

A preferred embodiment of the invention has been shown herein for purposes of illustration. Various changes in the structure as illustrated will no doubt occur to those skilled in the art. Such changes should be understood as forming a part of the invention insofar as they fall within the spirit and scope of the appended claims.

What is claimed is:

1. A carton formed from a blank of flexible sheet material which is pre-cut and scored to define panel and closure portions thereby permitting the blank to be folded and erected into a tubular carton for enclosing a nested stack of cups of the type having a rolled edge and a tapered sidewall body section, the one-piece blank including a pair of longitudinal side panels and a dispensing end panel interconnecting the side panels, the dispensing end panel having pre-cut portions and perforations which delineate a tear line forming the boundary of a dispensing opening, the portion of the end panel circumscribed by the tear line being removable to permit the withdrawal of a cup from a nested stack of cups enclosed within the carton, the dispensing opening being characterized by a substantially circular edge interrupted by a plurality of radially projecting tabs which are circumferentially spaced relative to each other around the periphery of the dispensing opening, the diameter of the circular edge being substantially equal to the outside diameter of the rolled edge of the cup, and the diameter as measured between radially opposite tabs being substantially equal to the outside diameter of the tapered sidewall body portion of the cup which is joined to the rolled edge.

2. A carton for singly dispensing a cup from a nested stack of cups of the type characterized by a rolled edge and a tapered body portion, the carton being formed from a blank folded to form side and end panels, one of the end panels having a dispensing opening formed therein for singly dispensing a cup from a nested stack enclosed within the carton, the dispensing opening being characterized by first and second groups of radially extending tabs, the tabs of the first group alternating with the tabs of the second group around the periphery of the dispensing opening, the radial extension of each tab in the first group being substantially equal to the outside diameter of the open rolled edge of the cup, and the radial extension of each tab in the second group coinciding with a relatively smaller diameter tapered body portion of the cup.

3. A collapsible carton for singly dispensing a cup from a nested stack of cups of the type having a rolled edge and a tapered sidewall body portion, the carton comprising an integral cut blank having side walls hingedly connected to permit the carton to be collapsed during shipping and to be folded when erected to enclose the stack, a filling flap hingedly connected to one of the sidewalls for covering a filling opening of the erected carton after a stack of cups has been inserted therein, and a dispensing panel hingedly connected to one of the side walls to cover the dispensing end, the dispensing panel having a tear line defined by perforations which delineate a dispensing opening bounded by first and second groups of radially extending tabs, the tabs of the first group alternating with the tabs of the second group around the periphery of the dispensing opening, the inside radial edge of each tab in the first group coinciding substantially with the outside diameter of the rolled edge of the cup, and the inside radial edge of each tab in the second group coinciding with a relatively smaller diameter portion of the tapered sidewall of the cup.

4. In combination, a disposable single-service cup dispenser carton and a stack of nested cups disposed within the carton, each cup of the nested stack being characterized by an open end having a rolled edge, a closed end, and a tapered sidewall section disposed intermediate the open end and closed end, the carton having side panels and a dispensing end panel interconnecting the side panels, the dispensing end panel having pre-cut portions and perforations which delineate a tear line forming the boundary of a dispensing opening, the portion of the end panel circumscribed by the tear line being removable to permit the withdrawal of a cup from the nested stack, the dispensing opening being characterized by a substantially circular edge interrupted by a plurality of radially projecting tabs which are circumferentially spaced relative to each other around the periphery of the dispensing opening, the diameter of the circular edge being substantially equal to the outside diameter of the rolled edge of the cup, and the diameter of the dispensing end panel portion enclosed by the tear line as measured between radially opposite tabs being substantially equal to the diameter of the open end of the cup which is joined to the rolled edge.

5. An article of manufacture comprising a blank of flexible sheet material which is pre-cut and scored to define panel and closure portions thereby permitting the blank to be folded and erected into a tubular carton having a rectangular cross section for enclosing a plurality of nested articles, the one-piece blank being characterized by:

a pair of longitudinally extending side panels, an integrally formed bottom end panel disposed intermediate the side panels, a top end closure panel integrally formed with one of the side panels, a top closure flap integrally formed with the other side panel, and first and second side closure flaps integrally formed on laterally opposite sides of each panel;

the intermediate boundary of each panel and side closure flap combination being delineated by a longitudinally extending score line, the intermediate boundary of each side panel and the bottom end panel being delineated by a laterally extending score line, the intermediate boundary of the top end closure panel and side panel combination being delineated by a laterally extending score line, and the intermediate boundary of the top closure flap and side panel combination being delineated by a laterally extending score line; and, the bottom end panel having pre-cut portions and perforations which delineate a tear line forming the boundary of a dispensing opening, the portion of the bottom end panel circumscribed by the tear line being removable to permit withdrawal of a nested article through the dispensing opening, the dispensing opening being characterized by a substantially circular edge interrupted by a plurality of radially projecting tabs which are circumferentially spaced relative to each other around the periphery of the dispensing opening.

* * * * *